United States Patent [19]

Bashour

[11] Patent Number: 4,498,597

[45] Date of Patent: Feb. 12, 1985

[54] CONTAINER AND CLOSURE

[76] Inventor: Joseph E. Bashour, R.R. #3, Glynwood, Wapakoneta, Ohio 45895

[21] Appl. No.: 572,403

[22] Filed: Jan. 20, 1984

[51] Int. Cl.[3] ..... B65D 41/04

[52] U.S. Cl. ..... 215/329; 215/31; 215/354

[58] Field of Search ..... 215/31, 329, 354; 53/486, 490

[56] References Cited

U.S. PATENT DOCUMENTS

| | | | |
|---|---|---|---|
| 3,901,404 | 8/1975 | Feldman | 215/256 |
| 3,980,195 | 9/1976 | Fillmore | 215/256 |
| 4,301,937 | 11/1981 | Von Hagel | 215/329 X |

*Primary Examiner*—Donald F. Norton

*Attorney, Agent, or Firm*—Renner, Kenner, Greive & Bobak

[57] ABSTRACT

A container (11) for use in combination with a closure (19) has a threaded neck portion (14) and a flexible lip portion (16) which extends inwardly and upwardly from the top of the neck portion (14) and which defines the opening (17) to the container (11). The closure (19) has a top portion (20) from which depends a threaded annular skirt (21) which cooperates with the threaded neck portion (14). An annular sealing ring (23) depends from the top portion (20) and has an outer diameter that is smaller than the inner diameter of the flexible lip portion (16).

6 Claims, 3 Drawing Figures

CONTAINER AND CLOSURE

TECHNICAL FIELD

The present invention relates generally to sealable closures for containers. More specifically the invention relates to plastic containers, such as milk bottles, and closures therefor which provide a positive seal against leakage of the contents from the containers.

BACKGROUND ART

Most liquid carrying containers, for example milk bottles, require a closure which tightly seals the opening of the container to prevent leakage of the contents therein. A typical container has a threaded neck with a horizontal, radially inwardly directed annular lip at the top of the neck which circumscribes the opening to the container. A typical threaded closure for use therewith is shown in Fillmore, U.S. Pat. No. 3,980,195, which includes an annular sealing ring having an outer diameter larger than the inner diameter of the container lip so that when the threaded cap is screwed onto the bottle, the sealing ring immediately engages the lip and forms a pressure seal. The ring is, essentially, forced into the smaller opening in the bottle, forming an interference type fitted seal between the annular sealing ring and the bottle lip. Typically the annular ring is compressed inwardly and the container lip is distorted downwardly under the pressure of the seal.

This commonly used seal can have several drawbacks. First, because of the use of an inteference fit, the cap may be misaligned as it is engaged to the bottle neck and considerable pressure or friction opposes the cap as it is turned onto the bottle neck. Consequently, cross threading may occur. A cross-threaded cap and bottle becomes a severe leaker due to the deformation of the plastic elements. Secondly, the interference fit causes the otherwise flat bottle lip to be distorted downwardly which prevents the machine finished edge of the bottle lip to be flush with the sealing ring of the cap. A proper seal, therefore, cannot form because the top of the bottle lip is now the engaging sealing surface, and this portion of the lip typically has a mold parting line, an irregularity in the surface of the lip, which causes a gap at the interface between the lip and sealing ring.

Another cap used to seal such containers is shown in Feldman, U.S. Pat. No. 3,901,404. Again, a primary seal is formed by the use of an oversized annular ring which forms an interference fit with the bottle lip. In order to circumvent the poor seal, Feldman utilizes a plurality of additional sealing surfaces spaced between the annular ring and the cap outer body. Though an effective seal can thus be achieved, such a cap is undesirable because of the more complex and expensive mold operations in making these caps.

It is thus apparent that the state of the art is such that the need exists for an inexpensive container and closure which will be effectively sealed against leakage of the contents and not require a complex molding operation.

DISCLOSURE OF THE INVENTION

It is, therefore, the primary object of the present invention to provide a new and improved container for use in combination with a sealable closure.

It is another object of the present invention to provide an improved seal between the container and closure to prevent leakage of the contents in the container.

It is a further object of the present invention to provide a container and closure which cooperate together without deleterious distortion thereof.

It is yet another object of the present invention to provide a closure which can easily and with minimal effort be installed on the container.

It is still a further object of the present invention to provide a container and closure which can be produced by conventional methods without involving complex and expensive molding operations.

It is still a further object of the present invention to provide a container which can be used with a conventional closure but which, in cooperation with such a closure, provides a new and improved seal against leakage.

These and other objects are accomplished by the improvements comprising the present invention, a preferred embodiment and one alternative embodiment of which are disclosed herein, by way of example only, as comprising the best known mode of carrying out the invention. Various modifications and changes in details of construction are comprehended, the invention being measured by the scope of the appended claims and not by the details in the specification.

In general, the container for use in combination with the closure, according to the concepts and method of the present invention, has a threaded neck which carries about its top perimeter a flexible lip. The flexible lip extends inwardly and upwardly from the top of the neck and thus defines the opening to the container. The closure for use with the container according to the present invention has a top portion from which depends a threaded annular skirt which cooperates with the threaded neck of the container. An annular sealing ring depends from the top of the closure and has an outer diameter that is smaller than the inner diameter of the flexible lip on the container. Thus, as the closure is threadably engaged with the container, the sealing ring enters the opening in the container but does not initially engage the lip of the container. The lip first engages the top of the closure and thereafter is bent downward towards the sealing ring and in contact therewith as the closure threadably engages the container neck.

PREFERRED EMBODIMENTS FOR CARRYING OUT THE INVENTION

Figure 1:
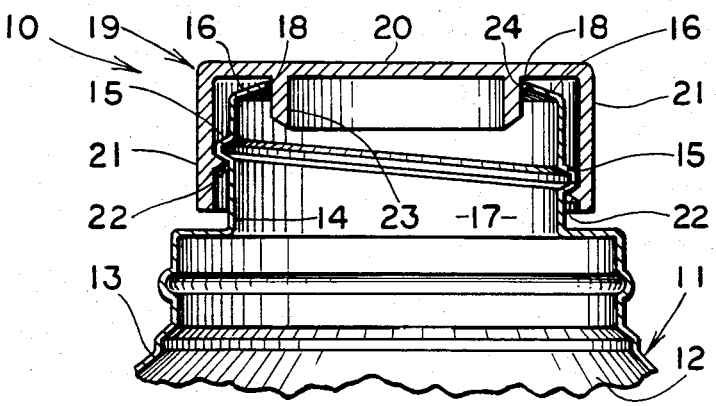
FIG. 1 is a sectional view of a container and a closure according to the concepts of the present invention, with only the uppermost portion of the container being shown and with the closure shown in a typical position initially engaging the container neck.

A container and closure embodying the concepts of the present invention are generally indicated by the numeral 10 in FIG. 1. As would be appreciated by one skilled in the art, container and closure 10 may be made by conventional plastic molding methods. The container, generally indicated by the numeral 11, has a vessel portion 12 (partially shown) with sufficient volume to hold the desired quantity of contents such as milk or juice. The top of vessel 12 may taper inwardly as at 13 and adjoin a neck portion 14 which may be an upwardly extending generally cylindrical wall. Neck 14 typically includes a thread 15 around its finished outer circumferential surface to allow a cap or other closure to be threadably engaged therewith.

Located around the top perimeter of neck portion 14 is a lip portion 16. Lip 16 extends inwardly and upwardly from the top perimeter of neck 14 and defines the opening 17 of container 11. Though the precise degree of upward draft of lip 16 is not critical, it has been found that typical inclinations of approximately 20° provide very satisfactory results. Lip 16 includes a generally flat, machined finished edge 18 which circumscribes opening 17 of container 11 and will provide the primary sealing surface as will be more fully described hereinafter.

The closure, generally indicated by the numeral 19, includes a generally circular top portion 20 which typically covers opening 17 of container 11. An annular skirt 21 depends from the outer periphery of top portion 20 and includes a thread 22 which may be integrally formed with skirt 21 and which cooperates with thread 15 on neck 14 so that closure 19 can be threadably engaged, as by rotation, with container 11.

An annular sealing ring 23 depends from top portion 20. According to the concepts of the present invention as depicted in an exemplary manner in FIG. 1, ring 23 is spaced inwardly from skirt 21 and has an outer diameter smaller than the inner diameter of lip 16, that is, the diameter of opening 17. Thus, as closure 19 is initially engaged with container 11, sealing ring 23 enters opening 17 without contacting lip 16. Thus, there is no obstruction to the engagement of closure 19 with container 11 and closure 19 can easily be rotated and thereby treadably engage container 11 without any deleterious cross-threading.

Figure 2:
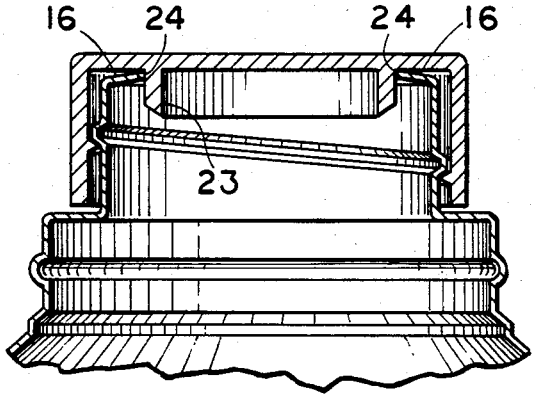
FIG. 2 is a sectional view of the container and closure shown in FIG. 1, the closure being shown in a typical position fully engaged with the container so as to effect a seal against leakage.

As torque is applied to closure 19 so as to engage it with container 11, the distal portion of flexible lip 16 will first contact top portion 20. As rotation of closure 19 continues, top portion 20 transmits a downwardly directed force on flexible lip 16. Because lip 16 is flexible it tends to bend downwardly under this force and generally flatten out, thereby decreasing the effective diameter of opening 17. That is, machine finished edge 18 tends to move downward and toward sealing ring 23. By controlling the accurate location and diametric size of sealing ring 23, lip 16 tends to flatten out so that edge 18 flushly and generally transversely engages ring 23 near the base 24 thereof, as shown in FIG. 2.

It will be appreciated by one skilled in the art that the precise rotational position of closure 19 when lip 16 engages ring 23 will be a function of the length of lip 16, the degree of upward inclination of lip 16 and the spaced distance of ring 23 from skirt 21. By selecting these parameters so that edge 18 flushly engages ring 23 after closure 19 is fully seated, a true and effective seal will be formed at the interface between edge 18 and ring 23. This seal is very effective, thereby eliminating the need to include secondary sealing surfaces and thereby minimizing the cost of the molding process. Because the outer diameter of ring 23 is smaller than the diameter of opening 17, closure 19 easily aligns with and rotates onto container 11 with elimination of any cross-threading problems. The tight interference fit does not engage until after lip 16 has been forced downwardly by top portion 20.

Figure 3:
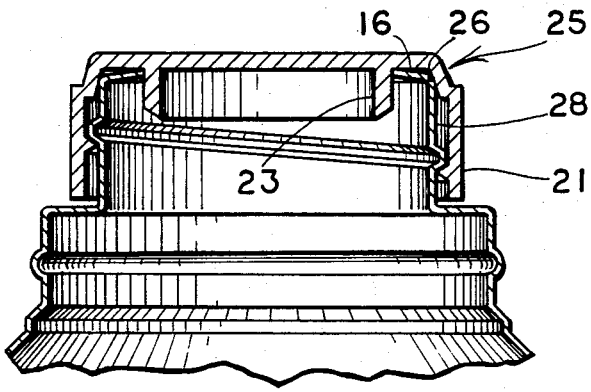
FIG. 3 is a section view of an alternative embodiment of the container and closure shown in FIG. 1.

An alternative embodiment of the present invention is shown in FIG. 3. The basic structure and operation is the same as above, however, annular skirt 21 may include an indented portion 25 near the top of skirt 21 which provides a reduced inner diameter of skirt 21. Indented portion 25 forms a restraining wall 26 which engages the outer surface 28 of neck portion 14 as closure 19 is threadably engaged with container 11. Wall 26 prevents undesirable expansion of neck 14 as edge 18 engages ring 23. That is, because neck 14 may be made of flexible plastic material, as closure 19 is torqued onto container 11, ring 23 will expandably push on lip 16 and tend to widen the diameter of opening 17. Walls 26 helps to prevent such widening by opposing any expansion of neck 14, thereby increasing the seal integrity at the interface of edge 18 and ring 23.

For both embodiments shown herein it will be appreciated that when closure 19 is rotated so as to disengage and remove it from container 11, lip 16 moves upward, thus increasing the diameter of opening 17 and allowing easy rotation and removal of closure 19.

Inasmuch as the present invention is subject to many modifications and changes in detail, a number of which have been expressly stated herein, it is intended that all matter described throughout this entire specification or shown in the accompanying drawings be interpreted in an illustrative sense and not limited thereto. It should be apparent that a container and closure constructed according to the concepts of the present invention, and reasonably equivalent thereto, will accomplish the objects of the present invention and otherwise substantially improve the art.

I claim:

1. In combination, a container and a closure; the container having a threaded neck portion and a flexible lip portion extending inwardly and upwardly from the top of said neck portion defining the opening for the container; the closure having a top portion, a threaded annular skirt depending from the periphery of said top portion for cooperating with said threaded neck portion of the container, and an annular sealing ring depending from said top portion and spaced from said annular skirt such that said sealing ring enters the opening in the container when said annular skirt threadably engages said neck portion; said sealing ring of the closure having an outer diameter which is smaller than the inner diameter of said lip portion of the container so that said lip portion first engages said top portion of the closure and thereafter said top portion bends said lip portion toward said sealing ring and in contact therewith when said annular skirt threadably engages said neck portion.

2. The combination of claim 1 wherein the opening for the container is circumscribed by a generally flat, finished edge on said flexible lip portion, said edge flushly engaging said sealing ring after said top portion bends said lip portion toward said sealing ring and in contact therewith.

3. The combination of claim 1 wherein said threaded annular skirt of the closure includes restraining means to engage said neck portion near the top of said neck portion to oppose outward expansion of said neck portion.

4. The combination of claim 3 wherein said restraining means is an indented portion of said annular skirt.

5. A method for sealing a container with a closure, the container having a threaded neck and the closure having a top portion and a threaded annular skirt which cooperates with the threaded neck and which depends from the periphery of the top portion comprising the steps of:

providing the container with a flexible lip portion which extends inwardly and upwardly from the top of the threaded neck;

providing the closure with an annular sealing ring which depends from the top portion and is spaced inwardly from the threaded annular skirt and which has an outer diameter smaller than the inner diameter of said flexible lip portion;

threadably engaging the annular skirt with the threaded neck by rotating the closure; and bending said flexible lip towards the sealing ring and in contact therewith by applying a downwardly directed force on said flexible lip as the closure is threadably engaged with the neck of the container.

6. The method for sealing a container with a closure according to claim 5 and further comprising the step of:

opposing outward expansion of the neck portion by engaging the neck portion near the top thereof.

* * * * *